United States Patent [19]

Marxer

[11] Patent Number: 4,723,364

[45] Date of Patent: Feb. 9, 1988

[54] INTERIOR LINING FOR SHELL-TYPE SPORTS SHOE

[75] Inventor: Herbert Marxer, Schaan, Liechtenstein

[73] Assignee: Lange International S.A.

[21] Appl. No.: 934,678

[22] Filed: Nov. 25, 1986

[30] Foreign Application Priority Data

Dec. 23, 1985 [CH] Switzerland ..... 5495/85

[51] Int. Cl.[4] ..... A43B 19/00; A43B 5/04

[52] U.S. Cl. ..... 36/10; 36/88; 36/119

[58] Field of Search ..... 36/10, 9, 117–121, 36/88, 93, 71

[56] References Cited

U.S. PATENT DOCUMENTS 4,268,931 5/1981 Salomon ..... 36/117
4,499,675 2/1985 Perotto ..... 36/119
4,523,392 6/1985 Gabrielli ..... 36/10
4,534,122 8/1985 MacPhail ..... 36/119 X

FOREIGN PATENT DOCUMENTS 2731450 2/1978 Fed. Rep. of Germany ..... 36/10
3429284 2/1986 Fed. Rep. of Germany ..... 36/119

*Primary Examiner*—James Kee Chi
*Attorney, Agent, or Firm*—Kane, Dalsimer, Kane, Sullivan and Kurucz

[57] ABSTRACT

The lining comprises an ankle part consisting of a front portion (4) and of a rear tongue (5) articulated at the level of the heel, and also of a portion (2) surrounding the foot. The lining possesses a transverse cut-out (20) on the instep, allowing free forward flexion of the ankle part. The portion extending over the foot possesses in addition a lengthwise slit (9) opening into the transverse cut-out (20) and allowing uniform gripping of the foot, preferably without any overlap of the two edges of this slit.

4 Claims, 1 Drawing Figure

INTERIOR LINING FOR SHELL-TYPE SPORTS SHOE

FIELD OF THE INVENTION

The present invention relates to an interior lining, in boot form, for a sports shoe having a rigid or semi-rigid shell, the ankle part of which consists of a rear tongue articulated at the level of the heel and of a front portion.

Sports shoes having a rigid or semi-rigid shell, particularly ski boots, are fitted with an interior lining in boot form, also referred to as an in-shoe, comprising a set of flexible panels which are joined together, these linings being intended to ensure the comfort of the foot within the rigid shell, guaranteeing a certain resilience in the gripping pressure exercised on the foot by the shell and ensuring good thermal insulation.

PRIOR ART

Essentially, there are at present three types of ski boot, the first characterized by a one-piece ankle part opening forward, the second type, known as rear-fitting, characterized by a two-piece ankle part possessing a rear portion which can be folded back, and the third characterized by a front portion in the form of a lid articulated at the front and enclosing the top of the foot and the front of the ankle part. The in-shoes used in the boots of the first and third types are designed as conventional shoes, possessing a cut-out opening at the front closed by an interior tongue fixed by its lower end to the portion of the in-shoe extending over the foot. Rear-fitting boots make use of an interior lining which is completely closed at the front and provided at the rear with a tongue which is capable of being pulled away backwards to allow fitting. When the leg is bent forward, in the downhill position, these types of interior lining create a resistance which is difficult to control, and become distorted transversely, forming creases which can constitute painful localized zones of compression, particularly on the tendon which passes over the instep. Moreover, in interior linings with a front tongue, the point at which the tongue is fixed requires, in order to ensure complete comfort of the foot, a precision which is difficult to observe in practice.

The object of the present invention is to provide an interior lining which eliminates the abovementioned disadvantages, that is to say a lining which permits forward flexion with a minimum of distortion and does not create a zone of compression on the tendon passing over the instep, bearing in mind that this tendon does not run in the median plane of the foot, but is offset relative to this plane, and that the central region of the tendon moves away from the heel during flexion.

SUMMARY OF THE INVENTION

The interior lining according to the invention is characterized in that the portion extending over the foot possesses a lengthwise slit extending over at least half the length of the said portion and offset relative to the center of the said portion, to the left for the right foot and to the right for the left foot respectively.

For each foot, the lengthwise slit extends above the tendon, so that the grip of the boot exercises, via the interior lining, a pressure on either side of the tendon but not on the tendon. The slit also permits the tendon to become distorted through the slit.

The lengthwise slit is advantageously complemented by a transverse cut-out on the instep, into which cut-out the lengthwise slit runs. This transverse cut-out in the zone of the instep in fact creates an articulation of the ankle part of the lining in a zone close to the articulation of the foot. The ankle part can thus pivot forward without substantially distorting the zone of the foot and the lateral portions at the level of the malleoli.

The interior lining according to the invention, being provided with a rear tongue, can be used in a top-fitting boot as well as with a rear-fitting boot or a boot having a front lid.

BRIEF DESCRIPTION OF THE DRAWINGS

The attached drawing represents, by way of example, an embodiment of the invention.

The single FIGURE of the drawing is a perspective view of an interior lining for a ski boot, which is more specifically intended for a top-fitting boot the shell of which possesses, on the instep, two portions whose edges overlap in order to grip the foot by means of buckles and cords or of any other gripping device.

DESCRIPTION OF THE PREFERRED EMBODIMENT

Figure 1:
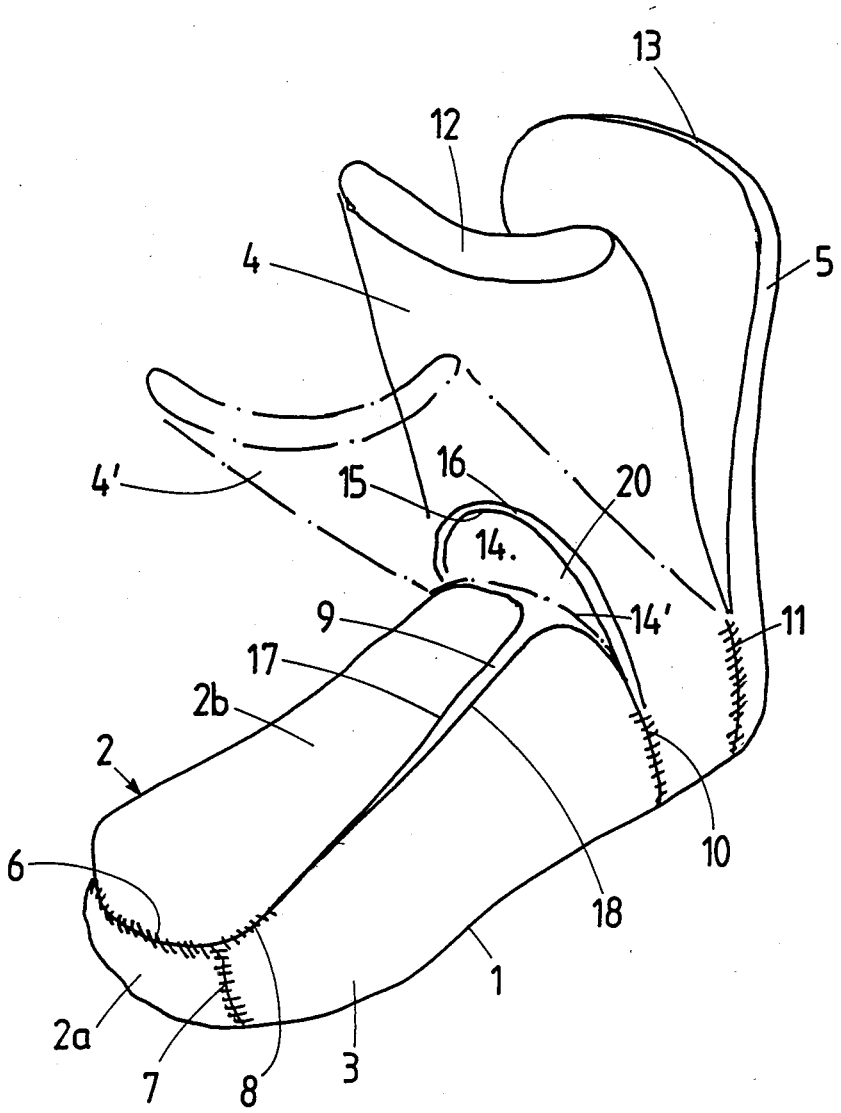

The interior lining shown comprises a fourth plantar panel 1 to which are sewn a first panel 2 forming the right-hand side of the foot, the end **2*a* of the foot and the top 2*b* of the foot, a second panel 3 forming the left-hand side of the foot, in the particular case shown the inner side of the right foot, a third panel 4, curved to form the front portion of the ankle piece of the lining, and a fifth panel 5 forming a tongue which constitutes the rear portion of the ankle piece of the lining. These panels are sewn to the edge of the sole 1. On the end of the foot, the portions 2*a* and 2*b* of the panel 2 are joined by a seam 6. At this same end of the foot, the portion 2*a* of the panel 2 and the panel 3 are joined by a seam 7. The portion 2*b* of the panel 2 and the panel 3 are also joined by a seam 8 over a length of about 3 cm. Behind the seam 8, the panels 2 and 3 are separated by a slit 9 which is offset relative to the median plane of the lining in a manner such that it corresponds to the position of the tendon of the foot passing over the instep. The slit 9** is therefore offset to the left for the right foot and to the right for the left foot.

The panels 2 and 3 extend back as far as the approximate center of the instep. The panel 4 is stitched, in its lower part, to the edge of the panel 3 by means of a seam 10, and, by a similar seam, to the opposite edge of the panel 2. In the back, the lower edges of the panel 4 are joined to the tongue 5 by a seam 11 on the left and by a similar seam on the right. The panel 4 is provided with a padding 12, while the panel 5 is provided with a similar padding 13. The seam 10 and the corresponding seam on the other side of the lining extend only for about 6 or 7 cm, so that above these seams the portion 4 of the ankle piece of the lining is separated from the panels 2 and 3, which surround the foot, by a transverse cut-out 20. This cut-out 20 is moreover accentuated by a cut-out opening 14 provided in the lower front edge of the portion 4. This cut-out opening 14 is approximately formed by a plane inclined at about 60° relative to the sole 1 and intersecting the curved panel 4. In the embodiment shown, the upper edge 15 of the cut-out opening 14 is however bent slightly forward. The edge of the cut-out opening 14 is formed by a welt 16.

The lengthwise slit 9 extends over the greater part of the foot. By opening, it makes the boot easier to fit. The length of the slit 9 is such that when the foot is gripped, for example by means of conventional buckles or of any other system, the edges 17 and 18 of the slit 9 move toward each other without touching, so that the lining offers virtually no resistance to the gripping and forms no crease or undulation capable of creating a localized pressure on the foot. On the other hand the existence of an open slit is not a disadvantage, as gripping on the instep is undesirable, since the tendon passing over the instep must be able to move away from the heel when the ankle is flexed forward.

On the other hand, when the skier flexes his leg forward, the portion 4 of the lining swings forward almost freely, and in every case without encountering resistance from the panels 2 and 3, as shown in the dot-and-dash-line position 4', by virtue of the presence of the transverse cut-out 20 on the instep. There is in fact distortion of the panel 4, but this is localized behind the malleoli.

As for the front tongue 5, this pivots more or less freely about a horizontal axis passing over the end of the seam 11 and of the corresponding opposite seam.

The panels forming the lining can be made from conventional materials such as sheets of synthetic material covered or coated by a synthetic fabric covered by a layer of synthetic foam.

The invention is not limited to the embodiment shown, but is capable of numerous variations. The transverse cut-out 20 on the instep may be more or less inclined. The cut-out opening 14 may possess an inclination of between 45° and 90° relative to the sole. Instead of being approximately defined by an intersecting plane, the cut-out opening 14 could also correspond approximately to the section of a curved surface, for example an approximately parabolic or cylindrical surface, or even a spherical surface. Moreover, the subdivision into panels as described could be entirely different. For example, the panel 3 could be made integral with the panel 4, and the same applies to panel 2.

The invention is not, moreover, limited to an interior lining made up of joined panels, but likewise extends to linings made up in any manner, particularly to one-piece linings of resilient injection-molded synthetic material.

I claim:

1. An interior lining in the form of a boot for a sports shoe having a rigid or semi-rigid shell, the ankle piece of which is formed by a rear tongue articulated at the level of the heel and by a front portion, wherein a portion surrounding the foot possesses a lengthwise slit extending over at least half the length of the said portion and offset relative to the center of the said portion, with the offset being to the left for the right foot and to the right for the left foot, respectively, said lengthwise slit having a width which increases from said lining's front end to said lining's instep area whereby said slit edges in the instep area can move toward each other without touching while said edges in said front end are touching.

2. An interior lining as claimed in claim 1, wherein the lining also possesses a transverse cut-out into which the lengthwise slit opens.

3. An interior lining as claimed in claim 2, wherein the upper edge of the transverse cut-out is formed by a rounded cut-out opening of the front portion of the ankle piece.

4. An interior lining as claimed in claim 3, wherein the said cut-out opening is formed approximately by an intersecting plane of the front portion of the ankle piece, which plane possesses an inclination of between 45° and 90° relative to the sole.

* * * * *